United States Patent [19]

Grayson et al.

[11] Patent Number: 5,058,542

[45] Date of Patent: Oct. 22, 1991

[54] ROCKER BOX COVER ASSEMBLY FOR INTERNAL COMBUSTION ENGINE

[75] Inventors: James M. Grayson, Pewaukee; Thomas L. Barnhardt, Menomonee Falls, both of Wis.

[73] Assignee: Briggs & Stratton Corporation, Wauwatosa, Wis.

[21] Appl. No.: 647,301

[22] Filed: Jan. 28, 1991

[51] Int. Cl.[5] ..... F01M 9/10

[52] U.S. Cl. ..... 123/90.38; 123/41.86; 123/195 C; 123/193 H

[58] Field of Search ..... 123/90.38, 195 C, 193 H, 123/198 E, 41.86

[56] References Cited

U.S. PATENT DOCUMENTS

| | | | |
|---|---|---|---|
| 4,212,281 | 7/1980 | Ernest | 123/193 H |
| 4,230,087 | 10/1980 | Abe et al. | 123/195 C |
| 4,495,903 | 1/1985 | Asano | 123/90.38 |
| 4,513,702 | 4/1985 | Koga et al. | 123/193 H |
| 4,542,720 | 9/1985 | Lyndhurst | 123/90.38 |
| 4,601,267 | 7/1986 | Kronich | 123/90.33 |
| 4,602,595 | 7/1986 | Aoki et al. | 123/41.86 |
| 4,662,322 | 5/1987 | Tamba et al. | 123/41.86 |
| 4,686,946 | 8/1987 | Umeda et al. | 123/90.38 |
| 4,721,090 | 1/1988 | Kato | 123/572 |
| 4,727,834 | 3/1988 | Isaka | 123/196 |
| 4,856,467 | 8/1989 | Kronich | 123/90.43 |
| 4,920,930 | 5/1990 | Sakano et al. | 123/41.86 |
| 4,969,434 | 11/1990 | Nakagawa | 123/90.38 |

*Primary Examiner*—David A. Okonsky
*Assistant Examiner*—Weilun Lo
*Attorney, Agent, or Firm*—Andrus, Sceales, Starke & Sawall

[57] ABSTRACT

An improved rocker box cover assembly for an overhead valve, horizontal crankshaft, internal combustion engine. The cover assembly is a pre-assembled unit attached to the cylinder head and includes an inner cover section, which defines a rocker arm chamber, and an outer cover section with the space between the sections defining an oil separating chamber. The inner cover section is provided with an opening that provides communication between the chambers and a check valve is mounted in the opening. A gas outlet is located in the upper portion of the oil separating chamber while a drain opening is located in the lower end of the separating chamber and separated oil drains through the drain opening and is returned to the crankcase.

8 Claims, 1 Drawing Sheet

FIG. 1
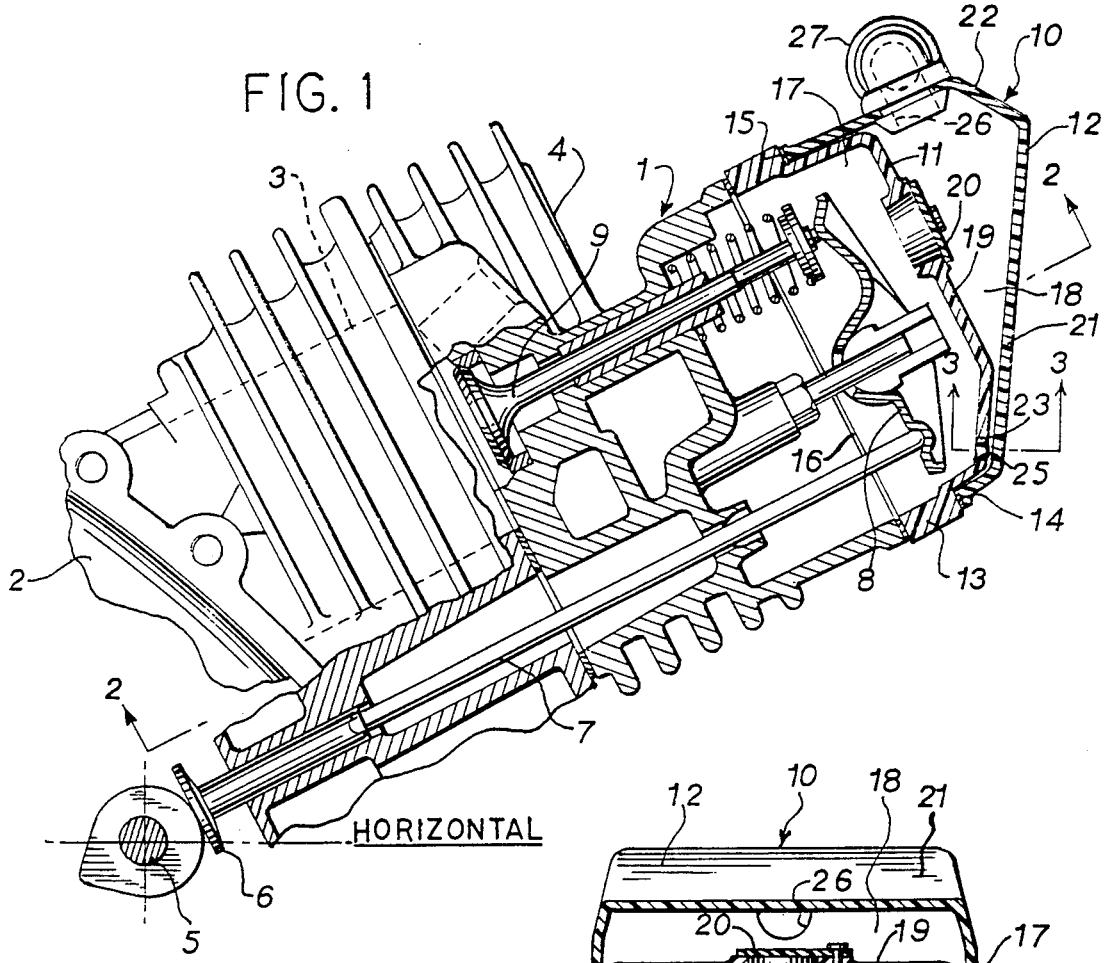
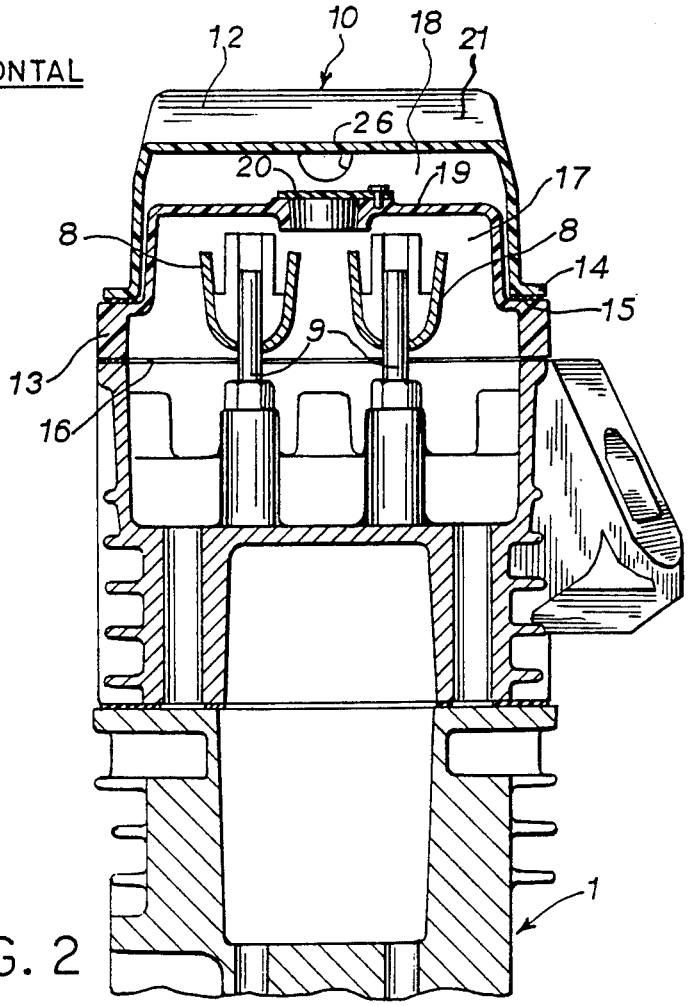
FIG. 2
FIG. 3
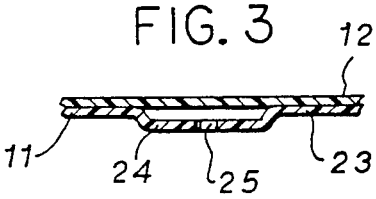

ROCKER BOX COVER ASSEMBLY FOR INTERNAL COMBUSTION ENGINE

BACKGROUND OF THE INVENTION

In operation of a four-cycle engine, gases produced in the combustion chamber forced under the increased pressure in the combustion chamber to flow through the gap between the piston and the cylinder wall into the crankcase. Additionally, in reciprocating piston engines, the compression of the crankcase by the piston downstroke becomes increasingly important with fewer numbers of cylinders, the greatest effect being in a single cylinder engine. These effects, if unattended, can cause a substantial rise in pressure in the crankcase causing leakage of engine oil. Therefore, it is customary in a four-cycle engine to provide a breather system for releasing the gas pressure.

In a typical breather system, the oil mist in the crankcase is subjected to positive pressure when the piston travels in a downstroke, and the oil mist is forced through a breather passage containing a check or breather valve to an oil separation chamber where the oil in the mist is separated from the gas. On the upstroke of the piston, the pressure in the crankcase changes from positive to negative and the separated oil is drawn back to the crankcase through a return passage by the pressure differential.

To avoid air pollution it is the usual practice to discharge the gas from the oil separating chamber to the air cleaner of the engine, as opposed to releasing the gas to the atmosphere.

In one known type of breather system, a pair of separate covers are attached to the cylinder head and define the rocker arm chamber and the oil separating chamber and a breather valve is mounted in an opening in the inner cover that defines the rocker arm chamber. However, with this type of rocker arm box cover, it is necessary to seal the inner cover to the cylinder head through a gasket and bolt arrangement, and similarly the outer cover is sealed by a gasket and bolts to the inner cover. Due to the use of the double gasket and bolt arrangements, the assembly of the covers to the cylinder head is a time-consuming task which is a substantial contribution to the overall labor cost in assembly of the engine.

SUMMARY OF THE INVENTION

The invention is directed to an improved rocker box cover assembly for an overhead valve, horizontal crankshaft, internal combustion engine. In accordance with the invention, the cover assembly is a pre-assembled unit, preferably formed of thermoplastic material, including an inner cover section and an outer cover section which is connected to and sealed to the inner cover section. The inner cover section is attached to the cylinder head and defines a rocker arm chamber, while the space between the two cover sections defines an oil separating chamber. Located in the central portion of the inner cover section is a check or breather valve that permits flow from the rocker arm chamber to the separating chamber, but prevents flow in the opposite direction.

An outlet port is formed in the upper end of the oil separating chamber and the gas which is separated from the oil mist is discharged through the port and preferably through a conduit to the air cleaner of the engine.

The oil separated from the oil mist in the separating chamber drains through a trough to the low end of the separating chamber and is discharged through a drain port to the rocker arm chamber and then through a return passage to the crankcase.

In operation of the engine, the downstroke of the piston will cause a pressure increase in the crankcase to force oil mist from the crankcase through a breather passage to the rocker arm chamber where the oil mist will lubricate the valve actuating mechanism. The pressure of the oil mist in the rocker arm chamber will open the breather valve to permit the mist to enter the separating chamber where the oil will separate from the gas, with the gas flowing through the outlet port to the air cleaner.

On the upstroke of the piston, the pressure in the crankcase will change from positive to negative, closing the breather valve and causing the separated oil in the separating chamber to be drawn through the drain port to the rocker arm chamber and back through the return passage to the crankcase.

The rocker box cover assembly of the invention is an integral pre-assembled unit with the outer cover section being sealed to the inner section and the breather valve installed in the opening in the inner section. Thus, the pre-assembled unit can be readily assembled with the engine block through use of a single gasket and bolts, and this substantially reduces the assembly time as opposed to prior practices. As the cover assembly of the invention requires only a single seal to the cylinder head, it eliminates the multiple sealed surfaces as required in the past and thus reduces the potential areas of leakage.

The cover assembly of the invention is of simple and inexpensive construction. The two cover sections are preferably formed of thermoplastic material and can be joined together by heat sealing to form the preassembled unit.

The rocker box assembly can be readily removed for service, reduces vibrational noise and provides improved aesthetics for the engine.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section showing a horizontal crankshaft, overhead valve engine incorporating the rocker box cover assembly of the invention;

FIG. 2 is a section taken along line 2—2 of FIG. 1;

FIG. 3 is a section taken along line 3—3 of FIG 1.

DESCRIPTION OF THE ILLUSTRATED EMBODIMENT

The drawings show an overhead valve single cylinder internal combustion engine with a horizontal crankshaft. The engine includes a cast metal block 1 having a crankcase 2 and defining a cylinder 3 which communicates with the crankcase. The opposite end of the cylinder is enclosed by head 4.

The engine itself is of conventional construction and includes a crankshaft, not shown, which is journaled within the crankcase and a piston is connected to the crankshaft via a crank arm. Camshaft 5 is journaled in the crankcase and operates valve tappets 6 which are connected through push rods 7 to end of rocker arms 8. The opposite ends of rocket arms 8 are operably connected to inlet and exhaust valves 9, only one of which is shown in FIG. 1.

As shown in FIGS. 1 and 2, a rocker arm cover assembly 10 is attached to cylinder head 4 and the cover assembly includes an inner cover section 11 and a superimposed outer cover section 12 Cover sections 11 and 12 are preferably formed of thermoplastic material, but also can be formed of other materials, as for example, die cast aluminum or magnesium alloys, adhesively joined.

Inner cover section 11 is formed with a peripheral flange 13 and the peripheral edge 14 of outer cover section 12 is sealed to flange 13 along a seal line indicated by 15. When formed of thermoplastic materials, the cover sections 11 and 12 can be sealed along line 15 by heat sealing or welding to provide a sealed joint.

Flange 13 of inner cover section 11 is sealed to the edge of cylinder head 4 by a gasket 16 and the cover section 11 is secured to the head by bolts, not shown, which are located at opposed corners of the cover assembly.

Inner cover section 11 defines a rocker arm chamber 17 which houses the rocker arms 8 or valve actuating mechanism, while the space between cover sections 11 and 12 defines an oil separating chamber 18.

The central portion 19 of inner cover section 11 is provided with an opening and a check or breather valve 20 is mounted in the opening. Valve 20 permits the flow of fluid from rocker arm chamber 17 to separating chamber 18, but prevents the flow in the opposite direction.

Valve 20 can take the form of a reed valve, a duck-bill valve, or a ball-type check valve, and the valves can operate with or without a return spring.

Outer cover section 12 includes a pair of upper surfaces 21 and 22 which meet at a ridge.

The lower end of inner cover section 11 is provided with an inclined surface 23 having a trough 24 which communicates with a drain hole 25, as seen in FIG. 3. Oil separated from the oil mist in separating chamber 18 will flow downwardly through trough 24 for discharge through drain hole 25 to rocker arm chamber 17 and then be returned to the crankcase. Drain hole 25 is relatively small so as to minimize loss of pressure differential between the cylinder and the separation chamber. The gas separated from the oil in chamber 18 is discharged through an outlet port 26 provided in the upper end of chamber 34 and can be conducted through conduit 27 to the air cleaner of the engine. Alternately, the gases can be discharged from chamber 18 directly to the atmosphere.

In operation of the engine, the downstroke of the piston will cause the pressure in the crankcase to increase to thereby force the oil mist from the crankcase through a breather passage, not shown, to rocker arm chamber 17 where the oil mist will lubricate the oil actuating mechanism. Increased pressure in the crankcase will cause the breather valve 20 to open to permit the oil mist to enter the separating chamber 18. The oil will separate or condense in chamber 18 with the gas being discharged through the upper outlet port 26 while the separated oil will drain through trough 24 toward drain hole 25.

On the upstroke of the piston, the pressure in the crankcase will be decreased causing the breather valve to close and the pressure differential will cause the separated oil to be drawn through the drain hole 25 to the rocker arm chamber 17 and then through a return passage to the crankcase.

With the breather system of the invention, the crankcase gases flow out on the power piston downstrokes and a vacuum is created and maintained on piston upstrokes.

The pre-assembled cover assembly can be readily attached to the cylinder head through use of a single gasket and bolts and this not only reduces the number of parts required for assembly, but also provides a substantial reduction in labor assembly costs and reduces the number of sealed joints through which possible leakage could occur.

Various modes of carrying out the invention are contemplated as being within the scope of the following claims particularly pointing out and distinctly claiming the subject matter which is regarded as the invention.

I claim:

1. A rocker arm cover assembly for an internal combustion engine, said engine having a cylinder having one end enclosed by a cylinder head and having the opposite end communicating with a crankcase, said engine also including a valve disposed in said head and valve actuating means for operating said valve, said cover assembly constituting a pre-assembled unit including an inner cover section and an outer cover section, said inner cover section being secured to said cylinder head and defining a first chamber to house said valve actuating mechanism, said inner cover section and said outer cover section defining a second chamber, aperture means in said inner cover section and providing communication between said chambers, check valve means disposed in said aperture means for permitting flow of oil mist from said first chamber to said second chamber, and for preventing flow in the opposite direction, said second chamber having a low end and drain means in said inner cover section and communicating with said low end for draining oil separated from said mist from said second chamber to said first chamber.

2. The cover assembly of claim 1, wherein said inner cover section has a peripheral flange, and said assembly includes connecting means for connecting said peripheral flange to said cylinder head.

3. The cover assembly of claim 2, wherein said outer cover section has a peripheral edge and said assembly includes sealing means for permanently sealing said edge to said peripheral flange.

4. The cover assembly of claim 1, and including outlet means connected to said second cover section for discharging gas separated from said mist from said second chamber.

5. The cover assembly of claim 4, and including conduit means connected to said outlet means for conducting separated gas to the intake of the engine.

6. The cover assembly of claim 3, wherein said cover sections are composed of plastic material and said sealing means comprises a heat sealed weld.

7. A rocker arm cover assembly for an internal combustion engine, said engine having a cylinder having one end enclosed by a cylinder head and having the opposite end communicating with a crankcase, said engine also including a valve disposed in said cylinder head and valve actuating means for operating said valve, said cover assembly constituting a pre-assembled unit including an inner cover section and an outer cover section, said inner cover section being secured to said cylinder head and defining a first chamber to house said valve actuating mechanism, said inner cover section and said outer cover section defining a second chamber, aperture means in said inner cover section and providing communication between said chambers, check valve means disposed in said aperture means for permitting flow of oil mist from said first chamber to said second chamber, and for preventing flow in the opposite direction, outlet means in said outer cover section and communicating with said second chamber for discharging gas separated from said mist from said second chamber, said inner cover section having a peripheral flange connected to said cylinder head, said outer cover section having a peripheral edge sealed to said peripheral flange, said second chamber having a low end, and drain means in said inner cover section and communicating with said low end for draining separated oil from said second chamber to said first chamber.

8. The cover assembly of claim 7, and including trough means formed in said inner cover section and communicating with said drain means.

* * * * *

UNITED STATES PATENT AND TRADEMARK OFFICE

CERTIFICATE OF CORRECTION

PATENT NO. : 5,058,542

DATED : October 22, 1991

INVENTOR(S) : JAMES M. GRAYSON ET AL

It is certified that error appears in the above-identified patent and that said Letters Patent is hereby corrected as shown below:

Col. 4, Line 23, CLAIM 1, Before "head" insert --cylinder--;
Col. 4, Line 36, CLAIM 1, After "end" insert --,-- (comma)

Signed and Sealed this

Twenty-fifth Day of May, 1993

*Attest:*

Michael K. Kirk

MICHAEL K. KIRK

*Attesting Officer*

*Acting Commissioner of Patents and Trademarks*